United States Patent [19]

Roller

[11] Patent Number: 4,740,876

[45] Date of Patent: Apr. 26, 1988

[54] SHOCK ABSORBING MOUNT FOR LAMP BULBS

[75] Inventor: Philip C. Roller, Ashville, N.Y.

[73] Assignee: Truck-Lite Co., Inc., Falconer, N.Y.

[21] Appl. No.: 116,336

[22] Filed: Nov. 3, 1987

[51] Int. Cl.[4] ..... F21V 15/04

[52] U.S. Cl. ..... 362/390; 362/61; 362/306; 362/429

[58] Field of Search ..... 248/603, 604, 614; 362/61, 80, 369, 390, 418, 419, 429, 306

[56] References Cited

U.S. PATENT DOCUMENTS

| | | | |
|---|---|---|---|
| 1,786,758 | 12/1930 | Larson | 362/390 |
| 3,327,110 | 6/1967 | Baldwin | 362/390 X |
| 4,231,081 | 10/1980 | Borruso | 362/390 X |
| 4,282,566 | 8/1981 | Newman | 362/390 X |

*Primary Examiner*—Stephen F. Husar

*Attorney, Agent, or Firm*—Mason, Fenwick & Lawrence

[57] ABSTRACT

A shock absorbing mount for a vehicle lamp bulb including an integral flexible plastic suspension member for supporting the bulb in spaced relation to a reflector with the bulb axis arranged horizontally. The suspension device has a central receptacle formation for receiving and supporting an end portion of the bulb horizontally, three flexible arms integrally joining the receptacle formation at equal circumferentially spaced locations each extending radially outwardly from a cylindrical surface of the receptacle at their roots and continuing outwardly as a serpentine recurved strip curving about a pair of horizontal axes of curvature along like vertical reverse curved paths for accommodating displacement of the central receptacle formation in all directions. The flexible arms having end formations to be pivotally connected to pillar formations of the reflector about parallel spaced horizontal axes for accommodating pivotal movement and axial adjustment of the adjacent end portions of the flexible arms about supporting posts extending from said mounting pillars.

18 Claims, 2 Drawing Sheets

SHOCK ABSORBING MOUNT FOR LAMP BULBS

BACKGROUND AND OBJECTS OF THE INVENTION

The present invention relates in general to lamp assemblies especially suitable for vehicle mounting, and more particularly to shock mounting of incandescent lamp bulbs with the bulb base mounted in a horizontal position to provide protection against impact and vibration.

Vehicle mounted lamp assemblies have for a long time been plagued with the problem of filament failure because of repetitive shock loading of the lamp assembly. Because of the frequent vibration and mechanical shocks, the lamps, especially on road vehicles, may fail quite rapidly and require frequent replacement.

For many years, shock mountings devised for reducing the shock forces imposed on bulb filaments involved considerably expensive arrangements from both the manufacturing and installation standpoint. While prior shock mountings were effective to a certain degree, they were not satisfactorily able to cope with impulse forces applied in certain directions to the lamp assemblies.

Various methods have been previously used for shock mounting of bulbs for vehicular use.

Among the techniques previously employed for attempting to reduce shock damage to lamps was the provision of metallic springs providing resilient suspension for the lamp bulbs, typical of which are the Gross U.S. Pat. No. 2,504,327, the Williamson U.S. Pat. No. 2,051,324 and Yost U.S. Pat. No. 1,948,690. However, such metallic spring suspension arrangements have little damping action. Elastomeric suspensions have also been used, but these have poor centering force and some elastomeric materials are susceptible to the high temperatures encountered, particularly in automotive head lamp application. The critical optics of head lamps and some other signalling lamps, require that the bulb filament be held precisely on the focus. If the bulb is displaced by impact or vibration it must return to design focus when the disturbing force is removed. The focus is fixed by design, but manufacturing variations in the lamp and the bulb make it difficult to reconcile the design focal point with the acutal focal point without some means of adjustment. In many prior art arrangements, the elastomeric bands or performed or molded elastomeric sockets and metallic spring systems have the undesirable property that when the lamp and suspension are at rest, the position of the bulb filament relative to the focus of the optical system is not easily adjustable.

The use of a plastic mounting with two sinusodal or substantially S-shaped bands or arms with pivoting ends and a vertically oriented bulb has been disclosed in the earlier Baldwin U.S. Pat. No. 3,327,110, reissued as U.S. Pat. No. Re. 30,498. However, the lamp bulb is this arrangement is potted with its base in the vertical position, rather than a horizontal position, and it is difficult to provide focusing of the bulb filament with respect to the lamp's optical system.

An object of the present invention is the provision of a novel shock mount for lamp bulbs, particularly for automotive or truck vehicle applications, specifically designed for horizontal oriented bulbs to offer resiliency in all planes of movement and to have a sufficiently strong centering force to ensure that the bulb will return to the proper focus after being disturbed by vibration or impact.

Another object of the present invention is the provision of a novel shock mount as described in the immediately preceding paragraph, which employs a three arm design with three horizontal pivots arranged in a triad to offer convenient means for adjusting the position of the bulb filaments in order to compensate for manufacturing variations in the bulb and optical system of the lamp.

Other objects, advantages and capabilities of the present invention will become apparent from the following detailed description, taken in conjunction with the accompanying drawings illustrating a preferred embodiment of the invention.

DETAILED DESCRIPTION OF PREFERRED EMBODIMENTS

Figure 1:
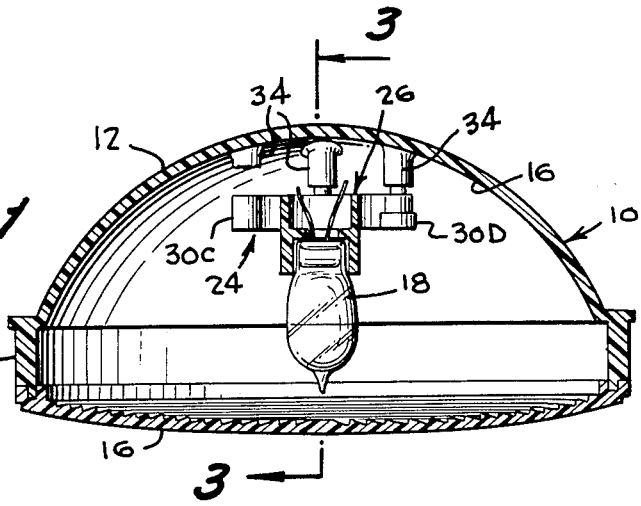
FIG. 1 is a horizontal section view through a lamp assembly embodying the present invention.
Figure 3:
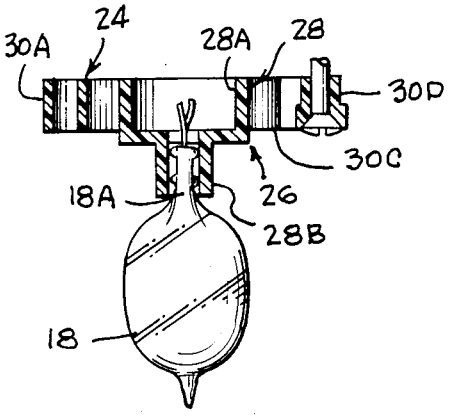
FIG. 3 is a vertical transverse section view taken along the line 3—3 of FIG. 1.
Figure 6:
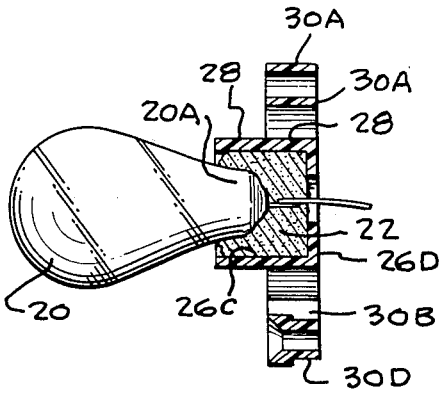
FIG. 6 is a vertical transverse section view taken long the line 6—6 of FIG. 6.

Referring to the drawings, wherein like reference characters designate corresponding parts throughout the several figures, the bulb shock mounting assembly for vehicle lamps of the present invention is designed for use in lamps for motor vehicles, such as trucks, trailers, automobiles and the like, and is specifically designed for horizontally oriented bulbs to offer resiliency in all planes of movement and to have a sufficiently strong centering force to ensure that the bulb will return to the proper focus after being disturbed by vibration or impact. Although the shock mount may be used in many different lamp housing configurations, one particular example is shown in FIGS. 1, 3 and 6, wherein the lamp assembly is denoted generally by the reference numberal 10 and includes a main housing 12 defining a curved reflector member adapted to be securely mounted in any suitable fashion on the associated vehicle wherein, in use, it may be subject to significant vibration or impact forces. The main housing 12 which forms the curved reflector member is generally in the form of a cup shaped body having a flanged rim portion 14 shaped to receive a lens cover 16 to be sealed to the forward face of the flanged rim 14 in a well known conventional manner. In the illustrated example, the reflector portion of the main housing defines a substantailly parabolic reflector surface 16 having a horizontal optical axis in the use position and may include a rearwardly projecting formation within which a plurality of electrical connector elements are housed, adapted to receive an electrical connecting plug as shown in U.S. Pat. No. Re. 30,498 through which electrical connections are established with the filaments of the lamp bulb to be supported in the housing 12.

Figure 2:
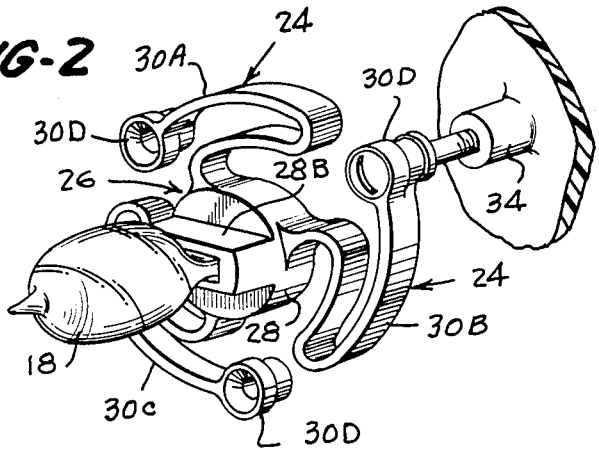
FIG. 2 is a perspective view of shock mount for horizontally oriented lamp bulbs of the type having a flattened transversely elongated oval base cross-section, embodying the present invention.
Figure 5:
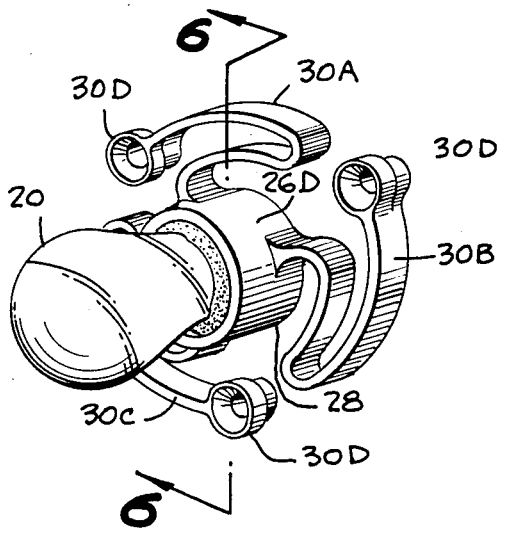
FIG. 5 is a front perspective view of a modified form of the shock mount designed to receive a potted base lamp of cylindrical configuration.

Two conventional configurations of lamp bulbs are shown in the illustrated embodiments of FIGS. 2, 3 and of FIGS. 5, 6, in the accompanying drawings, the lamp of FIGS. 2, and 3 being a flattened base type lamp bulb 18 having the flattened base portion 18*a* through which filament conductor leads extend, whereas the form shown in FIGS. 5 and 6 is a lamp bulb 20 of the unbased type having an end portion 20*a* through which the filament leads extend secured in position within the receptacle portion of the shock mount therefor by use of a resilient potting material, for example, of the type disclosed in prior U.S. Pat. No. 3,089,951, to hold the lamp in predetermined orientation relative to the reflector surface 16 to emit light through the lens cover 16.

Figure 4:
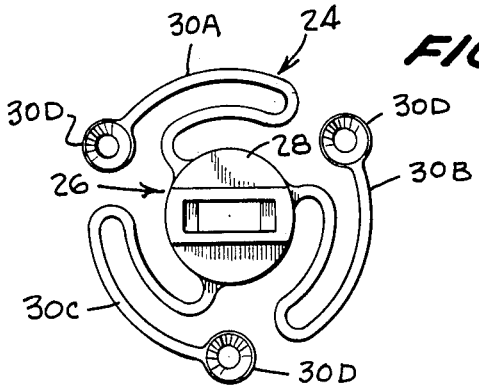
FIG. 4 is a front elevational view of the shock mount of FIG. 1, which the lamp removed.

In the form shown in FIGS. 2, 3 and 4, the shock mount indicated generally by the reference character 24 is formed as a molded unitary plastic member, for example, molded from nylon or similar plastic material, having a central receptacle portion 26 provided with an outer cylindrical surface 28, from which radiate three resilient serpentine, recurved arms 30A, 30B and 30C joined integrally to the cylindrical outer surface 28 of the central receptacle portion 26 and terminating at their outer most ends in cylindrical end anchor formations 30D each having its axis running parallel to the center axis of the central receptacle formation 26 and of the bulb 18 supported therein. The serpentine recurved shock mount arms 30A, 30B and 30C are of rectangular cross-section with the longer width dimension disposed parallel to the axis of the central receptacle formation 26 and the bulb 18 supported therein, and to the optical axis of the reflector surface 16, to receive the mounting posts 32 which may be of any one of several forms as later described, to achieve adjustment of the bulb along the horizontal axis of the lamp to achieve precise focusing relative to the reflector surface of the reflector formation or housing 12. The flexible arms may be of the same crosssectional dimensions throughout their length, or may be tapered in one or both dimensions along their length.

As illustrated in FIGS. 2 and 3, the central receptacle formation 26 of the shock mount 24 has a cylindrical rearmost portion defining the cylindrical outer surface 28 and forming a center annulus for the shock mount, together with a rectangular, horizontally elongated lamp-end-receiving portion 28B having its major axis extending transversely in a substantially horizontal plane and defining a cavity receiving the flattened end portion 18A of the lamp 18. The central receptacle portion 26 made up of the cylindrical portion 28A and the rectangular lamp-end-receiving formation 28B is of resilient plastic material and sized to be flexibly deformed upon forcing of the base portion 18*a* of the lamp 18 therein to tightly grip the same and hold the lamp securely in the central receptacle formation 26.

Figure 7:
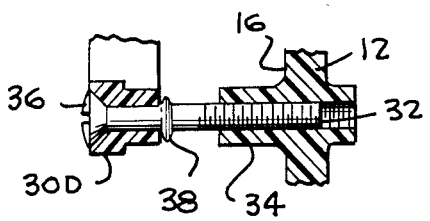
FIGS. 7, 8, 9 and 10 are fragmentary section views through the adjustable mounting post portion of the associated lamp housing and the adjacent cylindrical end portion of one of the resilient arms of the shock mount, showing different adjustable mounting arrangements for the shock mount.
Figure 8:
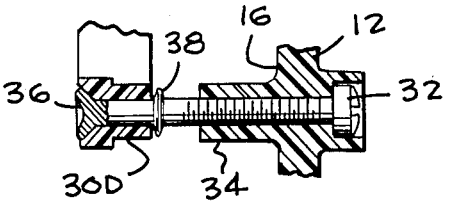
Figure 9:
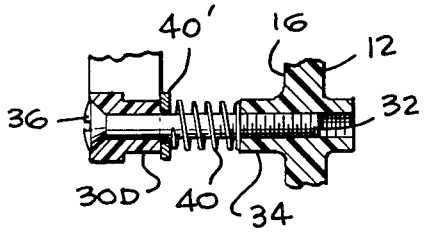
Figure 10:
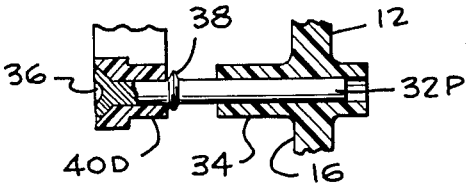

The cylindrical end anchor formations 30 have through holes at the center thereof through which the mounting posts 32 pass, with the posts 32 being free to turn within the holes. The posts 32 are made to move in and out along there axes relative to the lamp reflector member 12 and lens cover 16 by means of sliding in the post-receiving pedestal formations 34 molded as integral parts of the reflector shaped rear wall portion of the main housing member 12. Adjustment of the mounting posts 32, either by sliding them axially inwardly or outwardly along axes paralleling the central axis of the central receptacle formation 26 and associated lamp 18, or by rotating them and causing their threads to effect such axial movement of the posts 32, may be made from inside of the lamp assembly with the lens cover 16 removed, or outside with the lens cover in place if non-round sockets are provided in ends of the posts accessible through openings in the rear wall of housing 12 as shown in FIG. 8. Moving the posts 32 simultaneously moves the bulb 18 along the horizontal axis of the bulb, while adjusting the posts 32 differently produces vertical and lateral movement of the lamp bulb, thus allowing the lamp bulb to be focused precisely. The arms 30A, 30B and 30C are held in position on the mounting posts 32 by means of enlarged heads 36 such as screw heads and by collar formations 38, as shown in FIGS. 7 and 8, or by screw threaded posts having heads 36, springs 40, and associated washers 40', as shown in FIG. 9, or by slidable headed posts as indicated at 32P as shown in FIG. 10, or by other obvious means. Wiring is accomplished by flexible wires connected to the bulb lens of the lamp bulb 18 which are in turn connected to the external wiring by the electrical connecting plug through the connector elements as previously described, or by any other conventional connection system appropriate for the application.

The version shown in FIGS. 5 and 6 is adapted for use with an unbased lamp 20 by securing it in position in a body of resilient potting material 22 cured within the cylindrical forwardly opening well or cavity 26C of the cylindrical central receptacle formation 26D of FIGS. 5 and 6, which defines a cylindrical outer surface 28 like that of the FIGS. 2, 3 embodiment. Resilient serpentine recurved arms 30A, 30B and 30C otherwise having the same construction and configuration as the like serpentine arms of the FIGS. 2 and 3 embodiment extend from surface 28 by being integrally joined to and extending radially at their roots adjacent cylindrical surface 28 from that surface at substantially equidistant circumferentially spaced locations.

Acceleration caused by impact or vibration forces on the lamp and lamp assembly in use will be transmitted to the bulb 20 through the lamp housing 12 and the flexible arms 30A, 30B and 30C of the shock mount 24. If the acceleration is rapid enough, the inertia of the bulb 20 and receptacle formation 26 will cause the arms 30A, 30B and 30C to flex in a direction opposite to the direction of the acceleration. As the rate of acceleration slows, the spring action of the serpentine recurved arms 30A, 30B and 30C will tend to center the bulb 20. When the acceleration approaches zero, the bulb 20 will center and then overshoot due to inertia, and then center again, and continue this action for several cycles until the internal friction of the plastic material making up the arms 30A, 30B and 30C and rotating friction of the pivotal mounting points at the posts 32 dampens the action. This is of course a very simplistic example of the action. Actual acceleration loads imparted to the lamp 18 or 20 by the vibration of a vehicle and road impact can be very complex and tend to occur in all planes at the same time. The action of the suspension having the configuration of the presently described and illustrated shock mount tends to spread the acceleration out over a longer period of time thereby reducing "G" loads on the filament of the bulb 18 or 20.

I claim:

1. A shock absorbing mount for a bulb of a vehicle lamp assembly including a lamp housing defining a curved reflector surface having an optical axis disposed substantially horizontally and mounting pillar formations projecting therefrom, the shock mount comprising an integral flexible plastic suspension member for supporting a bulb in spaced relation to the reflector with the bulb having its axis arranged horizontally, the suspension device having a central receptacle formation for receiving and supporting an end portion locating the bulb in a predetermined horizontal orientation, the receptacle formation having a substantially cylindrical outer surface concentric with the bulb axis, three flexible arms integrally joining said receptacle formation at said cylindrical outer surface at equal circumferentially spaced locations each extending radially outwardly from said cylindrical surface at their roots immediately adjacent their junctures therewith and continuing outwardly as a serpentine recurved strip curving about a pair of horizontal axes of curvature along like vertical reverse curved paths for accommodating displacement of said central receptacle portion in all directions, said flexible arms having end formations to be pivotally connected to said pillar formations about parallel spaced horizontal axes for accommodating pivotal movement of the adjacent end portions of said flexible arms about supporting posts extending from said mounting pillars.

2. A shock absorbing mount as defined in claim 1, wherein said supporting posts are adjustable axially along axes paralleling said bulb axis for adjustment of the spacing of said flexible arms and said shock mount toward and away from said reflector surface.

3. A shock mount for a lamp assembly as defined in claim 1, wherein said flexible arms are of a strip shape of generally rectangular transverse cross-section having greater horizontal width than vertical thickness of a material to be flexibly deformed vertically and horizontally and thereby accommodate horizontal and vertical displacement of the receptacle formation and the portions of said arms between said receptacle formation and said pillars.

4. A shock mount for a lamp assembly as defined in claim 2, wherein said flexible arms are of a strip shape of generally rectangular transverse cross-section having greater horizontal width than vertical thickness of a material to be flexibly deformed vertically and horizontally and thereby accommodate horizontal and vertical displacement of the receptacle formation and the portions of said arms between said receptacle formation and said pillars.

5. A shock mount for a vehicle lamp assembly as defined in claim 1, wherein said central receptacle formation includes a thin ring-like annular band which is thin in a radial direction and of much greater width axially of the annular band and said flexible arms extend integrally therefrom as thin serpentine bands having a thickness substantially corresponding to the radial thickness of said annular band portion and having a width axially of the annular bands of corresponding width to the latter, said arms having a substantially S-shaped configuration defining a first substantially semicircular arcuate curved portion curving in a concave direction clockwise of the annular band portion in front elevation joined by a curved arm portion concentric with the axis of the annular band portion and thence forming a second substantially semicircular arcuate portion curving concavely in a counterclockwise direction which then joins a portion outwardly concentric with said first-mentioned concentric portion and the annular band portion extending counterclockwise to a cylindrical anchor portion forming said end formation spaced a short distance counterclockwise from and radially outwardly of the juncture of the associated arm with said annular band portion.

6. A shock mount for a vehicle lamp assembly as defined in claim 2, wherein said central receptacle formation includes a thin ring-like annular band which is thin in a radial direction and of much greater width axially of the annular band and said flexible arms extend integrally therefrom as thin serpentine bands having a thickness substantially corresponding to the radial thickness of said annular band portion and having a width axially of the annular bands of corresponding width to the latter, said arms having a substantially S-shaped configuration definig a first substantially semicircular arcuate curved portion curving in a concave direction clockwise of the annular band portion in front elevation joined by a curved arm portion concentric with the axis of the annular band portion and thence forming a second substantially semicircular arcuate portion curving concavely in a counterclockwise direction which then joins a portion outwardly concentric with said first-mentioned concentric portion and the annular band portion extending counterclockwise to a cylindrical anchor portion forming said end formation spaced a short distance counterclockwise from an raidally outwardly of the juncture of the associated arm with said annular band portion.

7. A shock mount for a vehicle lamp assembly as defined in claim 3, wherein said central receptacle formation includes a thin ring-like annular band which is thin in a radial direction and of much greater width axially of the annular band and said flexible arms extending integrally therefrom as thin serpentine bands having a thickness substantially corresponding to the radial thickness of said annular band portion and having a width axially of the annular bands of corresponding width to the latter, said arms having a substantially S-shaped configuration defining a first substantially semicircular arcuate curved portion curving in a concave direction clockwise of the annular band portion in front elevation joined by a curved arm portion concentric with the axis of the annular band portion and thence forming a second substantially semicircular arcuate portion curving concavely in a counterclockwise direction which then joins a portion outwardly concentric with said first-mentioned concentric portion and the annular band portion extending counterclockwise to a cylindrical anchor portion forming said end formation spaced a short distance counterclockwise from and radially outward of the juncture of the associated arm with said annular band portion.

8. A shock mount for a vehicle lamp assembly as defined in claim 1, including an elongated mounting post extending through each respective end formation of said three flexible arms, restrained against relative axial movement with respect to the associated flexible arm and supported for axial adjustment in its associated pillar of said reflector for focal adjustment of the shock mount relative to said reflector by movement of the bulb along the horizontal axis of the lamp, and said posts being adjusted differentially to produce vertical and lateral movement of the central receptacle formation focusing of the lamp.

9. A shock mount for a vehicle lamp assembly as defined in claim 2, including an elongated mounting post extending through each respective end formation of said three flexible arms, restrained against relative axial movement with respect to the associated flexible arm and supported for axial adjustment in its associated pillar of said reflector for focal adjustment of the shock mount relative to said reflector by movement of the bulb along the horizontal axis of the lamp, and said posts being adjusted differentially to produce vertical and lateral movement of the central receptacle formation for focusing of the lamp.

10. A shock mount for a vehicle lamp assembly as defined in claim 3, including an elongated mounting post extending through each respective end formation of said three flexible arms, restrained against relative axial movement with respect to the associated flexible arm and supported for axial adjustment in its associated pillar of said reflector by focal adjustment of the shock mount relative to said reflector for movement of the bulb along the horizontal axis of the lamp, and said posts being adjusted differentially to produce vertical and lateral movement of the central receptacle formation for focusing of the lamp.

11. A shock mount for a vehicle lamp assembly as defined in claim 5, including an elongated mounting post extending through each respective end formation of said three flexible arms, restrained against relative axial movement with respect to the associated flexible arm and supported for axial adjustment in its associated pillar of said reflector for focal adjustment of the shock mount relative to said reflector by movement of the bulb along the horizontal axis of the lamp, and said posts being adjusted differentially to produce vertical and lateral movement of the central receptacle formation for focusing of the lamp.

12. A shock mount for a vehicle lamp assembly as defined in claim 6, including an elongated mounting post extending through each respective end formation of said three flexible arms, restrained against relative axial movement with respect to the associated flexible arm and supported for axial adjustment in its associated pillar of said reflector for focal adjustment of the shock mount relative to said reflector by movement of the bulb along the horizontal axis of the lamp, and said posts being adjusted differentially to produce vertical and lateral movement of the central receptacle formation for focusing of the lamp.

13. A shock mount for a vehicle lamp assembly as defined in claim 1, wherein said central receptacle formation includes a substantially rectangular socket formation integral with and extending forwardly from the cylindrical portion of said central receptacle formation defining a forwardly opening rectangular cavity for receiving a flattened base of a flat base lamp bulb therein, and said cylindrical portion and the sinuous strips forming said flexible arms defining bands having substantially the same width axially of the center axis of the shock mount as said cylindrical formation.

14. A shock mount for a vehicle lamp assembly as defined in claim 4, wherein said central receptacle formation includes a substantially rectangular socket formation integral with and extending forwardly from the cylindrical portion of said central receptacle formation defining a forwardly opening rectangular cavity for receiving a flattened base of a flat base lamp bulb therein, and said cylindrical portion and the sinuous strips forming said flexible arms defining bands having substantially the same width axially of the center axis of the shock mount as said cylindrical formation.

15. A shock mount for a vehicle lamp assembly as defined in claim 5, wherein said central receptacle formation includes a substantially rectangular socket formation integral with and extending forwardly from the cylindrical portion of said central receptacle formation defining a forwardly opening rectangular cavity for receiving a flattened base of a flat base lamp bulb therein, and said cylindrical portion and the sinuous strips forming said flexible arms defining bands having substantially the same width axially of the center axis of the shock mount as said cylindrical formation.

16. A shock mount for a vehicle lamp assembly as defined in claim 7, wherein said central receptacle formation includes a substantially rectangular socket formation integral with and extending forwardly from the cylindrical portion of said central receptacle formation defining a forwardly opening rectangular cavity for receiving a flattened base of a flat base lamp bulb therein, and said cylindrical portion and the sinuous strips forming said flexible arms defining bands having substantially the same width axially of the center axis of the shock mount as said cylindrical formation.

17. A shock mount for a vehicle lamp assembly as defined in claim 11, wherein said central receptacle formation includes a substantially rectangular socket formation integral with and extending forwardly from the cylindrical portion of said central receptacle formation defining a forwardly opening rectangular cavity for receiving a flattened base of a flat base lamp bulb therein, and said cylindrical portion and the sinuuos strips forming said flexible arms defining bands having substantially the same width axially of the center axis of the shock mount as said cylindrical formation.

18. A shock mount for a vehicle lamp assembly as defined in claim 1, wherein said cylindrical portion of said central receptacle formation defines a forwardly opening cup shaped cylindrical recess receiving a base portion of the lamp bulb and

* * * * *